US011234528B2

(12) United States Patent
Theodoran

(10) Patent No.: US 11,234,528 B2
(45) Date of Patent: Feb. 1, 2022

(54) REMOVABLE SWIM-UP DOCK BAR

(71) Applicant: Thomas Theodoran, Kewadin, MI (US)

(72) Inventor: Thomas Theodoran, Kewadin, MI (US)

( * ) Notice: Subject to any disclaimer, the term of this patent is extended or adjusted under 35 U.S.C. 154(b) by 0 days.

(21) Appl. No.: 15/929,789

(22) Filed: May 21, 2020

(65) Prior Publication Data

US 2021/0361073 A1 Nov. 25, 2021

(51) Int. Cl.

| | |
|---|---|
| ***E04H 4/14*** | (2006.01) |
| ***A47C 11/00*** | (2006.01) |
| ***A47C 15/00*** | (2006.01) |
| ***A47C 9/06*** | (2006.01) |
| ***A47C 9/00*** | (2006.01) |
| ***A47C 3/34*** | (2006.01) |
| ***A47F 9/00*** | (2006.01) |
| ***A47C 3/40*** | (2006.01) |
| *E02B 3/06* | (2006.01) |

(52) U.S. Cl.

CPC ..... *A47C 15/004* (2013.01); *A47C 3/34* (2013.01); *A47C 3/40* (2013.01); *A47C 9/007* (2013.01); *A47C 9/06* (2013.01); *A47C 11/005* (2013.01); *A47F 9/00* (2013.01); *E02B 3/068* (2013.01); *E04H 4/14* (2013.01)

(58) Field of Classification Search

CPC .. A47C 9/007; A47C 3/28; A47C 3/40; A47C 9/06; A47C 11/005; A47C 3/34

USPC ..... 297/135, 175 R, 248, 344.18, 423.1, 461

See application file for complete search history.

(56) References Cited

U.S. PATENT DOCUMENTS

| | | | | | |
|---|---|---|---|---|---|
| 850,453 | A * | 4/1907 | Winans | A47C 9/007 | 248/371 |
| 1,049,159 | A * | 12/1912 | Simmel | F16B 7/04 | 403/59 |
| 1,513,907 | A * | 11/1924 | Hugo | A47C 9/022 | 297/174 R |
| 2,428,534 | A * | 10/1947 | Stelzer | A47F 9/00 | 297/174 R |
| 3,261,640 | A * | 7/1966 | Straits | A47C 11/005 | 297/135 |
| 3,366,415 | A * | 1/1968 | Cooper | A47B 13/10 | 297/158.3 |
| 4,052,100 | A * | 10/1977 | Nikitits | A47B 3/14 | 297/158.4 |
| 4,277,101 | A * | 7/1981 | Vogel | B60N 2/00 | 297/232 |

(Continued)

FOREIGN PATENT DOCUMENTS

| | | | | |
|---|---|---|---|---|
| CA | 2244413 A1 * | 2/2000 | E04H 4/14 | |
| DE | 4125291 A * | 4/1992 | A47B 39/00 | |

(Continued)

OTHER PUBLICATIONS 2 page PDF of Derwent 1997-43550 which is published abstract and clipped image of ZA 9609054-A. The examiner was unable to locate the original patent. (Year: 1997).*

*Primary Examiner* — Robert Canfield

(74) *Attorney, Agent, or Firm* — Mitchell Intellectual Property Law, PLLC

(57) ABSTRACT

A removable swim-up dock bar is described. The dock bar is removably attachable to a submerged foundation of an existing dock and may have adjustable seats or adjustable legs to ensure proper height and stability.

2 Claims, 4 Drawing Sheets

(56) References Cited

U.S. PATENT DOCUMENTS

| | | | | | |
|---|---|---|---|---|---|
| 4,903,926 | A * | 2/1990 | McNarry | E04H 4/14 | 211/86.01 |
| 5,584,606 | A | 12/1996 | Hoogasian, Jr. | | |
| 5,673,968 | A * | 10/1997 | Ponzio | A47C 9/022 | 297/143 |
| 5,860,171 | A * | 1/1999 | Hicks | E04H 4/14 | 4/496 |
| 6,311,343 | B1 * | 11/2001 | Wisniewski | E04H 4/144 | 4/496 |
| 6,793,039 | B2 | 9/2004 | Schmid, Jr. | | |
| 8,506,010 | B2 * | 8/2013 | Kane | A47B 37/04 | 297/158.3 |
| 8,616,630 | B1 * | 12/2013 | Midkiff | A47B 83/02 | 297/174 R |
| 9,260,879 | B1 * | 2/2016 | Benhacene | A47D 1/10 | |
| 10,041,623 | B2 * | 8/2018 | Aiderman | A47B 83/02 | |
| 10,681,983 | B2 * | 6/2020 | Olarte | A47C 7/56 | |
| 2008/0092285 | A1 * | 4/2008 | Petersen | E04H 4/14 | 4/496 |
| 2016/0367034 | A1 | 12/2016 | Johnston et al. | | |
| 2021/0172190 | A1 * | 6/2021 | Steinman | A47C 1/146 | |

FOREIGN PATENT DOCUMENTS

| | | | | |
|---|---|---|---|---|
| DE | 29602311 U1 * | 7/1996 | A45B 11/00 | |
| DE | 29807383 U1 * | 7/1998 | A47C 9/06 | |
| EP | 0188002 A2 * | 7/1986 | A47C 1/12 | |
| GB | 2302504 A * | 1/1997 | A47C 1/121 | |
| GB | 2368783 A * | 5/2002 | A47C 9/06 | |
| GB | 2575465 A * | 1/2020 | A47C 9/06 | |

* cited by examiner

REMOVABLE SWIM-UP DOCK BAR

BACKGROUND

This disclosure relates to accessories for docks, in particular a removeable swim-up dock bar.

Outdoor water entertainment and leisure activities are common in open water environments, such as lakes, ponds, and rivers. Typical activities include swimming, boating, and fishing. Many water-front landowners have docks that extend into their abutting open water. From these docks, water recreationists often attach ladders, slides, and other accessories to partake in water activities.

Water recreationists may desire to spend time in the water partially submerged while enjoying conversation and a beverage. Many resort hotel swimming pools offer a swim-up bar, which allows users to comfortably sit while partially submerged in pool water. Swimming pool swim-up bar seats are generally permanently fixed with posts attached to the bottom of the pool floor.

Landowners, on the other hand, may desire for the bar seating to be removable, particularly in open water that experiences freezing and thawing through the seasons. Removable dock attachments also ensure that the landowner can safely stow away the dock bar when the landowner is not home, ensuring the dock cannot be stolen or misused by trespassers. Landowners may also desire for the dock bar to attach to the submerged foundation of the dock to ensure stability and to maintain a coherent and aesthetic appearance.

Bar-stool-like seating may be desired to be adjustable to account for changes in water depth due to unusually wet seasons that see the water level rise and ebb. This may be accomplished by having at least one adjustable leg to adjust the overall height of the dock bar or adjustable seats. Adjustable seats may also be desirable for individualized adjustment based on the user.

Numerous designs have been proposed to implement a dock bar. U.S. Patent Publication No. 2016/0367034 shows a single aquatic seat attaches to the topside of a dock through bolts and screws. U.S. Pat. No. 6,793,039 discloses a removeable platform that attaches to a dock to aid swimmers to get in and out of the open water.

A need exists for a swim-up bar that removably attaches to a dock. A need for a single swim up bar apparatus that includes multiple seats for ease of installation and for multiple recreationalists may enjoy themselves. Further, a need exists for a swim up bar that has the attachment mechanism located under the dock, to create a less cumbersome use for the user when using the existing dock as a bar. Additionally. in locations where water freezes and thaws based on the seasons, a need exists have dock attachments be removable, as to ensure that they are not damaged with the freezing over of the ice. Removable dock attachments also ensure that the attachments be safely stowed away when the landowner is not home, ensuring they cannot be stolen or misused by trespassers.

An object of the disclosure is to provide a removable dock bar that provides seating to its users.

Another object is to provide a dock bar that is removably attachable to an existing dock.

An additional object is to provide a dock bar that is removably attachable to the submerged foundation of an existing dock.

Another object is to provide a dock bar that allows for adjustments to be made to the height of the seats of the dock bar without adjusting the couplings attaching the bar to the dock.

An additional object is to provide a dock bar that allows for adjustments made to the legs of the dock bar to ensure a sturdy and strong base for the enjoyment of the dock bar by users.

Further objects to the disclosure will appear as the description proceeds.

To the accomplishment of the above and related objects, this disclosure may be embodied in the following disclosure form illustrated in the accompanying drawings, attention being called to the fact, however, that the following disclosure and accompanying drawings are illustrative only and that changes may be made in the specific construction illustrated and described within the scope of the appended claims.

SUMMARY

Disclosed herein are embodiments of a removable dock bar. The dock bar comprises: a substantially horizontal main support beam having a first side and a second side opposing the first side; a seat foundation sheath attached to the first side of the main support beam and extending away from the first side of the main support beam; a seat having a stem which is adjustably disposed within the seat foundation sheath; a leg foundation sheath attached to the second side of the main support beam and extending away from the second side of the main support beam; a leg which is adjustably disposed within the leg foundation sheath; a dock attachment arm attached to the main support beam having a first end attached to the main support beam, and second end opposite the first end; and a dock coupling located at the second end of the dock attachment arm, wherein the seat foundation sheath and the leg foundation sheath comprise a plurality of vertically spaced apertures, the dock attachment arm and the main support beam form an interior angle of less than about 180 degrees, the dock attachment is reversibly attachable to a submerged base of a dock, and the dock bar comprises water-resistant material.

BRIEF DESCRIPTION OF THE DRAWINGS

The disclosure is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

DETAILED DESCRIPTION

Figure 1:
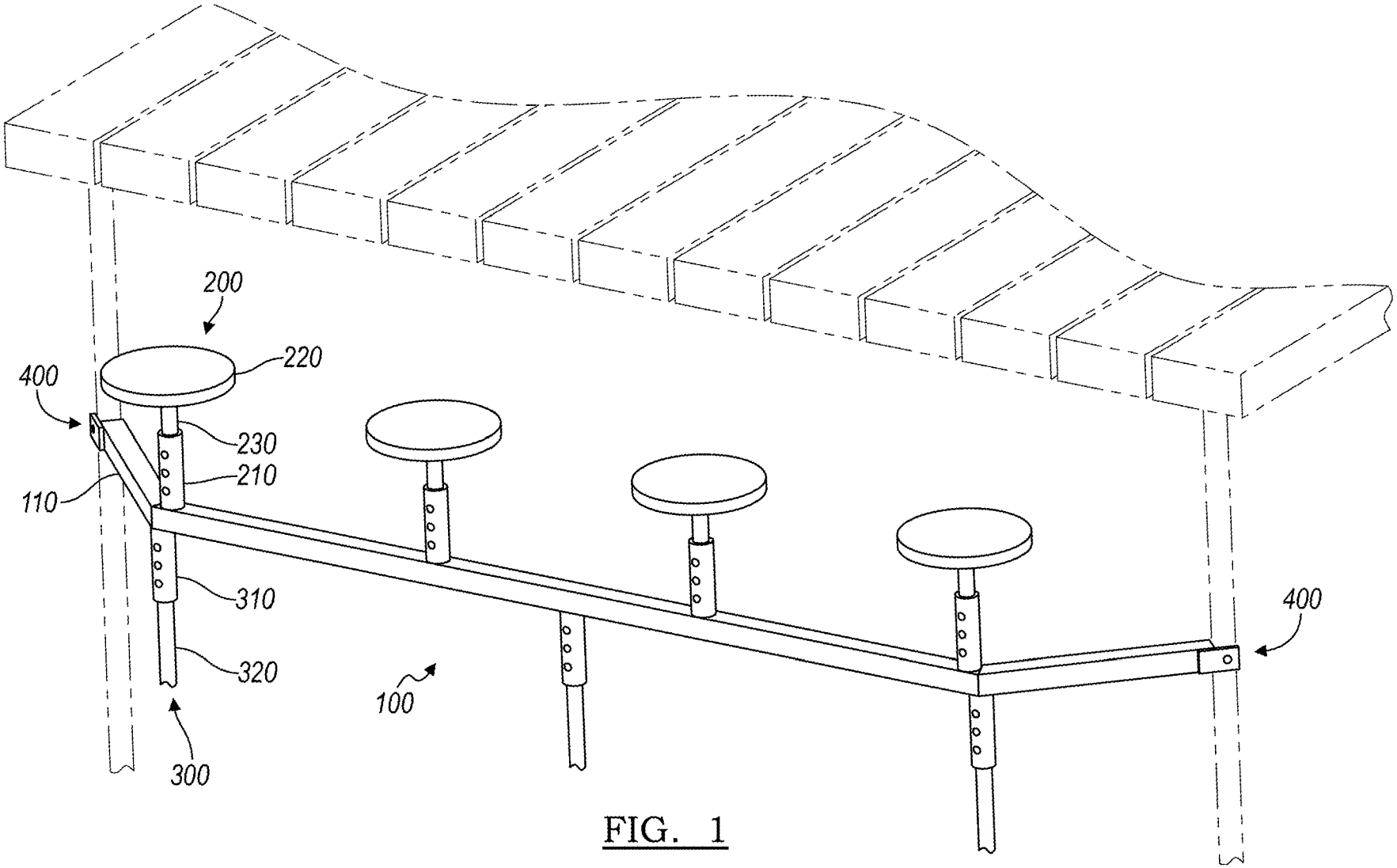
FIG. 1 is an axonometric view of one embodiment of the swim-up dock bar.

As seen in the embodiment pictured in FIG. 1, the dock bar may have a main support beam 100. The main support beam 100 may be substantially horizontal. The main support beam 100 may be comprised of water-resistant material. Possible water-resistant materials include galvanized steel, plastic, treated wood, concrete, aluminum, stainless steel, and clay. The frame may be manufactured through the process of 3D printing, molding, steel bending, welding, among others. The main support beam 100 may be described as having a central region and end regions.

The dock attachment arms 110 may be located at any point along the main support beam 100. The main support beam 100 may have dock attachment arms 110 attached to the end regions. In alternative embodiments, a dock attachment arm 110 may be attached to the central region. The dock attachment arms 110 may form an interior angle with the main support beam 100. This interior angle may be less than about 180 degrees. In alternative embodiments, the interior angle may be about 90 degrees.

Seat assembly 200 may be attached to a first side of the main support beam 100. The seat assembly 200 may be made of water-resistant material. Water-resistant materials may include galvanized steel, plastic, treated wood, concrete, aluminum, stainless steel, clay, among others. The seat assembly 200 consists of a seat foundation sheath 210, a seat 220, and a seat stem 230. The seat assembly 200 may be manufactured through a process of 3D printing, molding, bending steel, welding, among others.

Leg assembly 300 may be attached to a second side of the main support beam 100, opposite of the first side of the main support beam 100. The leg assembly 300 may be made of water-resistant materials, which may include, among others, galvanized steel, plastic, treated wood, concrete, aluminum, stainless steel, and clay. The leg assembly 300 may have a leg foundation sheath 310 and a leg 320. The leg 320 may be adjusted to support the dock bar on the bottom of the body of water.

Coupling 400 may be located at the end of the dock attachment arm 110. The coupling 400 may function to removably attach to existing submerged dock support legs. The coupling 400 may be made of a water-resistant material, including, among others, galvanized steel, plastic, treated wood, concrete, aluminum, stainless steel, and clay.

Figure 2:
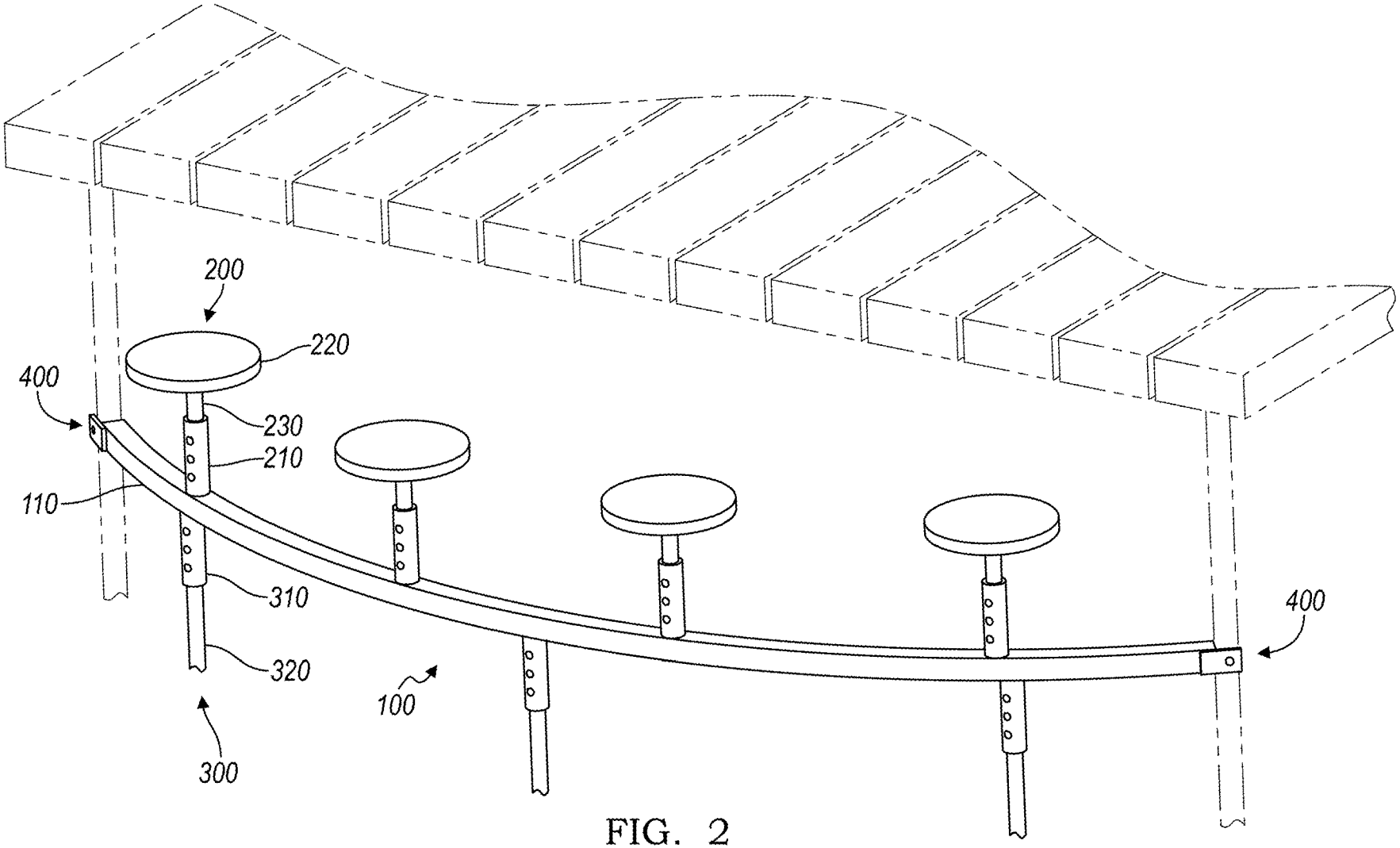
FIG. 2 is an axonometric view of another embodiment of the swim-up-dock bar.

Moving to FIG. 2, an alternative embodiment where the main support beam 100 is curved and the dock attachment arms 110 are contiguous to the main support beam 100. In the embodiment shown in FIG. 2, persons sitting on the seats may use the dock as a bar to rest their arms.

Figure 3:
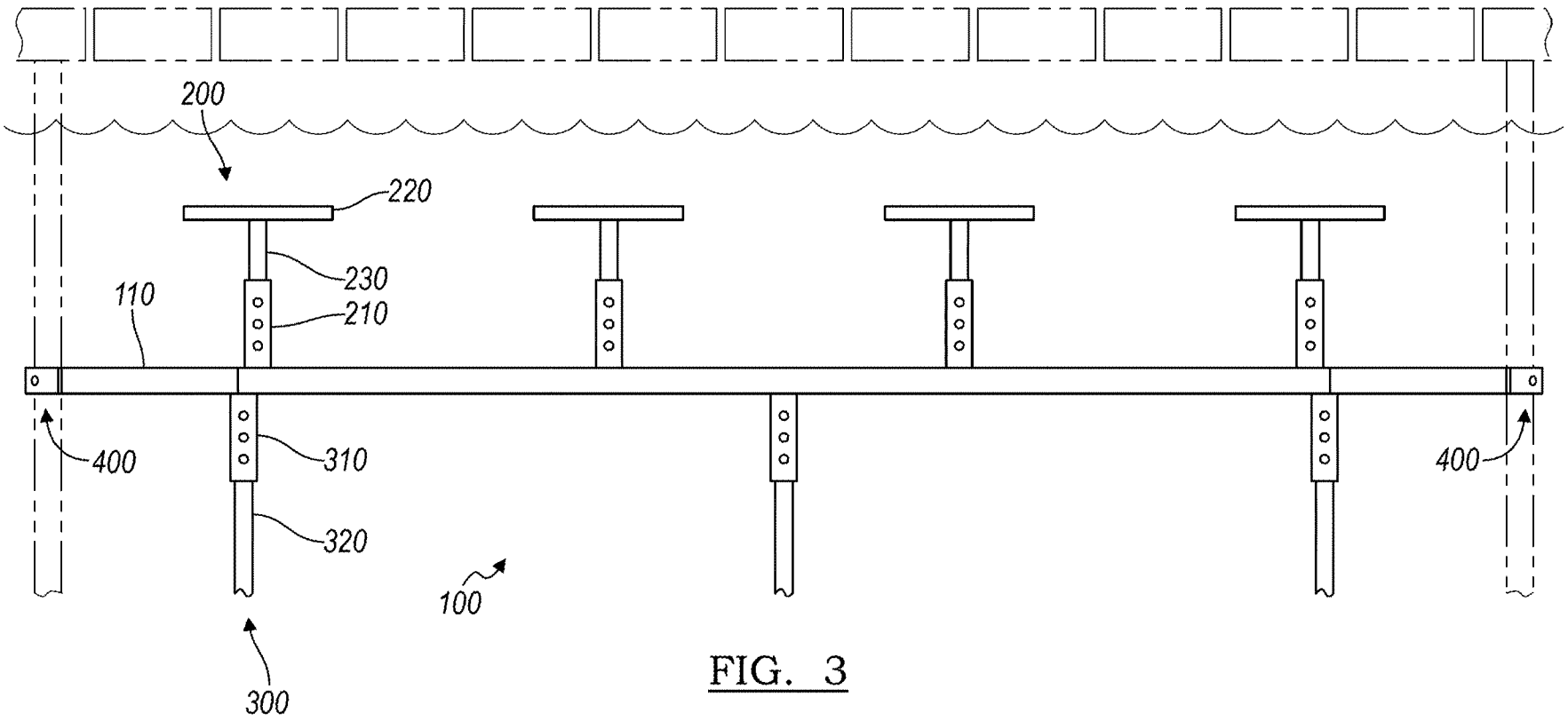
FIG. 3 is a perspective view of one embodiment of the swim-up dock bar.

As seen in FIG. 3, the dock bar attached to a dock is shown. The coupling 400 is attached to the dock base and submerged in the water. The coupling 400 may be attached at the desired depth.

Figure 4:
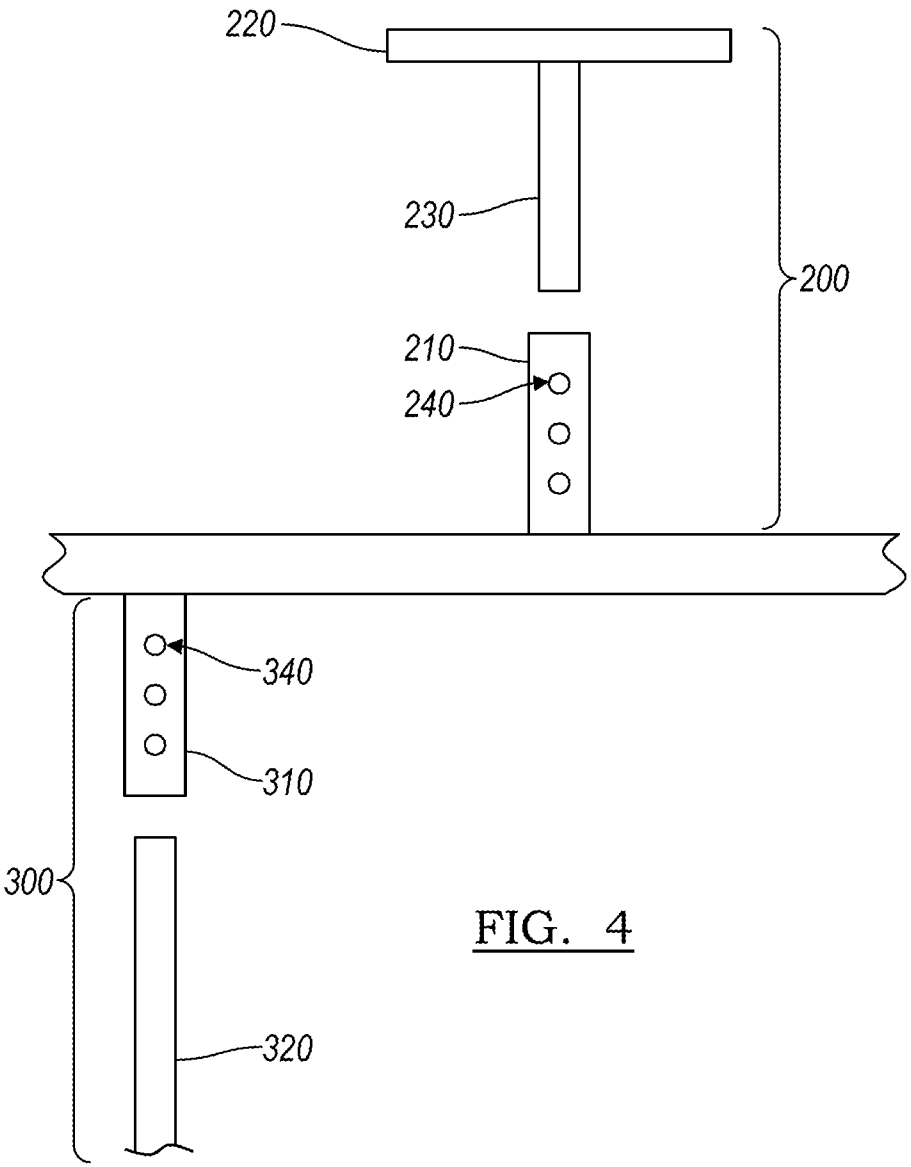
FIG. 4 is an exploded view of one embodiment of swim-up dock bar.

As seen in FIG. 4, a breakdown of the seat assembly 200 and leg assembly 300 may be attached to the main support beam 100. The seat stem 230 may be disposed within the seat foundation sheath 210. The seat foundation sheath 210 may comprise a plurality of apertures 240 for adjusting the height of the seat 220 relative to the main support beam 100. The leg 320 may be as long as needed for the water depth. The leg 320 may be disposed within the leg foundation sheath 310. The leg foundation sheath 310 may comprise a plurality of apertures 340 for adjusting the leg height to the desired depth.

The plurality of apertures in the seat foundation sheath 240 as well as the plurality of apertures in the leg foundation sheath 340 may be used to implement an adjustment mechanism for adjusting the height of the seat stem and the leg. The adjustment mechanism may be, but is not limited to, a screw and bolt, and a pin. The adjustable nature of these assemblies allows the user to make adjustments to the height of the dock bar without making cumbersome adjustments to the installation of the couplings.

The dock bar may be installed to an existing dock. The couplings 400 may be removably attached to the submerged base of the existing dock. The leg assembly 300 may be adjusted to firmly plant the legs 320 into the bottom of the body of water. The seat assembly 200 may be adjusted to the desired height for users based on their height and how far they wish to be above or below the existing dock.

While the disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A dock bar comprising:

a substantially horizontal main support beam comprising a central region and two outer end regions terminating in respective dock-coupling ends; a seat assembly attached vertically to a first upper side of the central region of the main support beam;

a leg assembly attached vertically to a second lower side of the main support beam: and a dock coupling attached to each of the respective dock-coupling ends of the two outer end regions of the main support beam, each dock coupling configured to be removably attachable to a submerged base of a dock, wherein the two outer end regions extend laterally outward and forward from the central region relative to a forward dock-facing side of the central region, such that the two outer end regions and the dock coupling at each of the respective dock-coupling ends of the two outer end regions are located laterally outward and forward of the central region wherein the two outer end regions extend laterally outward and forward from the central region with an interior angle between the central region and the respective dock-coupling ends of the two outer end regions greater than 90 degrees and less than 180 degrees, wherein the two outer end regions extend laterally outward and forward from the central region and the seat assembly by curving in an arc outwardly and forwardly of the central region.

2. In combination with a dock having a submerged base, a dock bar removably attached to the submerged base of a dock, comprising:

a substantially horizontal main support beam comprising a central region and two outer end regions terminating in respective dock-coupling ends;

a plurality of seat assemblies attached vertically to a first upper side of the central region of the main support beam, the seat assemblies being spaced along the central region of the main support beam;

a leg assembly attached vertically to a second lower side of the main support beam; and, a dock coupling attached to each of the respective dock-coupling ends of the two outer end regions of the main support beam, each dock coupling removably attached to the submerged base of the dock, wherein the two outer end regions extend laterally outward and forward from the central region and the seat assemblies toward the dock, such that the dock coupling at each of the respective dock-coupling ends of the two outer end regions is removably attached to the submerged base of the dock laterally outward and forward of the central region and the seat assemblies to define an unobstructed underwater area between the seat assemblies and the dock.

* * * * *